US005549098A

United States Patent [19]

Bales et al.

[11] Patent Number: 5,549,098

[45] Date of Patent: Aug. 27, 1996

[54] GLASS RANGE TOP-SEAL SYSTEM

[75] Inventors: Michael E. Bales, New Palestine, Ind.; Paul D. Noel, Troy, Ohio; Steve M. Schatz, New Palestine, Ind.

[73] Assignee: Maytag Corporation, Newton, Iowa

[21] Appl. No.: 197,233

[22] Filed: Feb. 16, 1994

[51] Int. Cl.[6] ..... F24C 15/10

[52] U.S. Cl. ..... 126/211; 126/39 B; 126/39 F

[58] Field of Search ..... 126/211, 39 B, 126/39 F

[56] References Cited

U.S. PATENT DOCUMENTS

| | | | |
|---|---|---|---|
| 2,858,548 | 11/1958 | Switzer | 126/214 A |
| 2,947,005 | 8/1960 | Switzer | 126/214 A |
| 2,968,815 | 1/1961 | Hornik | 126/211 X |
| 4,060,069 | 11/1977 | Drouin . | |
| 4,214,571 | 7/1980 | Scherer . | |
| 4,243,016 | 1/1981 | Kristen et al. . | |
| 4,453,533 | 6/1984 | Scheidler et al. . | |
| 4,627,415 | 12/1986 | Kamo et al. | 126/211 X |
| 4,665,893 | 5/1987 | Miyagawa et al. | 126/39 BA X |
| 5,036,831 | 8/1991 | Ray . | |
| 5,185,047 | 2/1993 | Ray . | |
| 5,317,129 | 5/1994 | Taplan et al. | 126/211 X |

*Primary Examiner*—Larry Jones

*Attorney, Agent, or Firm*—Willian Brinks Hofer Gilson & Lione

[57] ABSTRACT

A reliable, easily installable and replaceable range top system sealingly and removably connects a sealed glass panel to the structure of a range top. The system comprises a glass panel-elastic seal assembly, including a glass range top panel and an elastic seal attached at the periphery of the glass range top panel, a carrier for the glass panel-elastic seal assembly and means for removably fastening the glass panel into sealing engagement with the range top structure without tools, the fastening means providing an easily disengageable interlock with the range top structure.

24 Claims, 3 Drawing Sheets

GLASS RANGE TOP-SEAL SYSTEM

FIELD OF THE INVENTION

The present invention relates to sealed glass range tops, particularly to systems providing sealed glass range top panels, and still more particularly, to systems for providing sealed and removable glass range top panels.

BACKGROUND OF THE INVENTION

In the past, the tops of ranges have been constructed from steel and coated with an enamel surface. In recent years, however, manufacturers have begun using glass and ceramic range top panels. Glass is a popular surface for a cooking appliance because it provides, among other advantages for the user, a smoother, lustrous and attractive surface that is easily cleaned. Unfortunately, it is difficult to seal around the glass range top and is particularly difficult to provide an easily removable and sealable glass range top.

Typically, the glass panels used in ranges and range tops fit into a framework. In order to keep foreign material, such as spilled food, from seeping past the glass panel and into the interior of the range, the glass panels are sealed in place by hand, for example, by application of a bead of silicone RTV caulking material peripherally between the panel and the mounting frame. Such a manufacturing step requires great attention and control and is labor intensive. In addition, once the panel is sealed in position, service or repair of any components located under the panel presents a problem. To perform such service or repair, the glass panel must be removed, which destroys the peripheral seal. Of course, the original caulking material must be cleaned from the glass panel and new RTV caulking must be applied during reinstallation to reseal the glass panel in the range top, adding time and material cost to the cost of service and repair. Thus, a system that can provide a reliable, easily installable seal around glass range top panels capable of precluding spills, boilovers and other foreign matter from the range top interior, and that can provide removability, allowing easy access to components under the range top for maintenance or repair without destroying the seal or its integrity, is needed and would be advantageous to manufacturers, service personnel and consumers alike.

SUMMARY OF THE INVENTION

The invention comprises such a reliable, easily installable and replaceable sealed glass panel in a range top, and particularly comprises a range top system sealingly and removably connecting a glass range top panel to the structure of a range top. The apparatus of the invention comprises a glass panel-elastic seal assembly, including a glass range top panel and an elastic seal attached at the periphery of the glass range top panel, a carrier for the glass panel-elastic seal assembly and means for removably fastening the glass panel into sealing engagement with the range top structure without tools, the fastening means providing an easily disengageable interlock with the range top structure.

According to one preferred aspect of the invention, the elastic seal comprises an elastomeric band, including a top surface with a panel-receiving groove to carry and seal against the glass range top panel, with the top of the glass panel flush with the top surface of the elastomeric band. The preferred elastomeric band also includes, as fastening means, at least one depressed portion, such as a groove, formed on the outwardly-facing surface of the elastomeric band. The top surface of the elastomeric band can further include a peripheral lip projecting outwardly from the outwardly-facing surface to assist in forming a sealing engagement of the elastomeric band against the range top structure.

According to another preferred aspect of the invention, such a preferred glass panel-elastic seal assembly is connected with the range top structure, preferably with a mounting framework, by a carrier including a resilient portion that provides removability and a sealing engagement of the elastic seal with the range top structure. A preferred carrier includes a flange adapted for engagement with the elastomeric band, and the resilient portion of the carrier comprises fastening means that urge the elastomeric band into sealing engagement with the mounting framework. The mounting framework includes protruding means, such as one or more inwardly projecting dimples, for engaging the outwardly facing surface of the elastomeric band. Advantageously, the resilient portion of the carrier can be deformed to disengage the elastomeric band from the mounting framework to allow easy access to the interior of the range top for maintenance or repair without destroying the integrity of the elastic seal or its reinstatability.

By providing a glass panel that is sealingly engaged with an elastomeric band and removably connected with the range top structure by a carrier and a fastening means that resiliently urges the elastomeric band into a sealed connection with mounting framework, the present invention provides a removable glass panel which is aesthetically pleasing while providing an effective, easily installable seal between a range top and a glass panel.

Additional objects, features, and advantages of the invention will become apparent to those skilled in the art upon consideration of the drawings and the following detailed description of a preferred embodiment exemplifying the best mode of carrying out the invention as presently perceived.

DETAILED DESCRIPTION OF THE DRAWINGS

Figure 1:
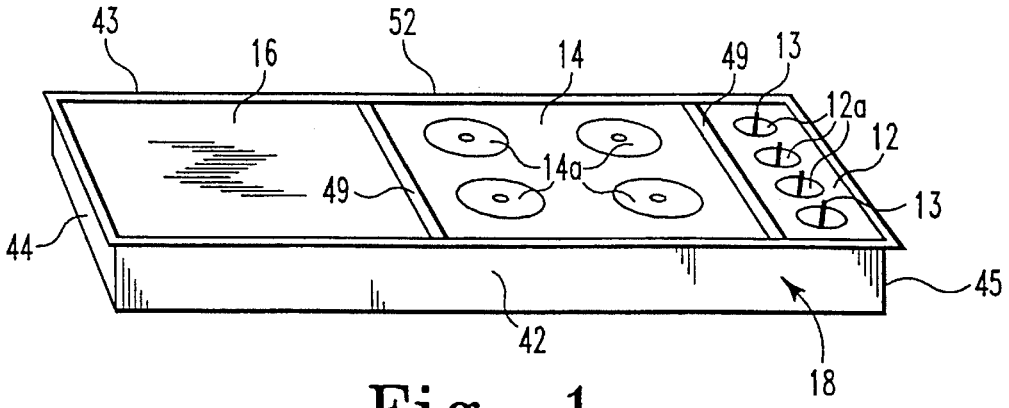
FIG. 1 is a perspective view of an illustrative range top showing a glass range top panel.

A range top 10 having a plurality of range top panels, such as a control panel 12, a burner panel 14 and a grill-cover panel 16, set into a mounting frame 18 is illustrated in FIG. 1. The panels 12, 14, 16 are formed of glass or ceramic and provide an attractive finished appearance to the range top 10 by providing a smooth, lustrous top surface and concealing the interior structure of the range top, which is contained within the mounting framework 18. The present invention will be discussed in connection with the glass control panel 12, but it will be appreciated that the discussion can apply equally well to the other panels of the range top 10 and to panels formed from other materials, such as ceramics.

The control panel 12 is a generally rectangular glass plate having a plurality of control-receiving apertures 12*a*. The controls associated with the glass control panel (not shown) can control the burners 14*a* (and an exhaust fan) and are mounted on a carrier for the glass control panel 12, as described below, so that their knob receiving operating shafts 13 extend up through the apertures 12*a*. Control knobs (not shown) are coupled to the operators 13 for controlling their respective controls, which may be electric switches or gas range valves. Typically, the knobs are sized to completely cover the apertures 12*a* to provide an attractive finished appearance to the range top 10.

The invention includes a glass panel-elastic seal assembly 20 (FIG. 2) that is removably and sealingly engaged with the mounting framework 18 of the range top 10. A preferred elastic seal comprises an elastomeric band 26, shown in FIGS. 2, 8–9, which includes first and second longitudinal portions 22 and 24 and a pair of end portions (not shown) extending transversely between and joining the opposing ends of the longitudinal portions 22, 24. The first and second longitudinal portions 22, 24 and the end portions combine to form a closed, generally rectangular peripheral loop around glass panel 12. The elastomeric band 26 is formed to engage and seal with the glass control panel 12 around the entire perimeter of the glass panel. The elastomeric band 26 is preferably made from an elastomeric material, such as silicone rubber, and includes a top surface 28, an outwardly-facing surface 30, and an inwardly-facing surface 32. The elastomeric band 26 is formed to include an inner groove 34 for receiving the glass panel, a peripheral seal-assisting lip 36, a first depression, or groove 40, formed in the first longitudinal portion 22, and a second depression or groove 41, formed in the second longitudinal portion 24.

The top surface 28 is formed to include the inner panel-receiving groove 34 that extends from the inwardly-facing surface 32 toward the outwardly-facing surface 30 and downwardly from the top surface 28. The panel-receiving groove 34 is shaped to exactly conform to the outer edge of the control panel 12 so that the top surface of the control panel 12 is flush with the top surface 28 of the elastomeric band 26. The seal-assisting lip 36 extends outwardly from the outwardly-facing surface 30 and is flush with the top surface 28.

The outwardly-facing surface 30 is formed to include the first depression 40 for engagement with one or more projecting portions of the mounting framework 18. First depression 40 is preferably a first receiving groove 40 that extends along the length of the first longitudinal portion 22. The second longitudinal portion 24 is formed to provide a second depression 41, which is also preferably a second receiving groove 41 that extends along the length of the second longitudinal portion 24. The preferred first receiving groove 40 and second receiving groove 41 are generally semi-circularly shaped depressions in the outwardly-facing surface of elastomeric band 26.

The mounting framework 18 includes a pair of parallel side walls 42, 43 and a pair of parallel end walls 44, 45. The walls 42, 43, 44, 45 are welded together to form a rectangular box, as illustrated in FIG. 1. A plurality of cross members 47 (FIGS. 8–10) extend across the box structure between the parallel side walls 42, 43, generally adjacent the adjacent edges of panels 12, 14 and 16.

Figure 3:
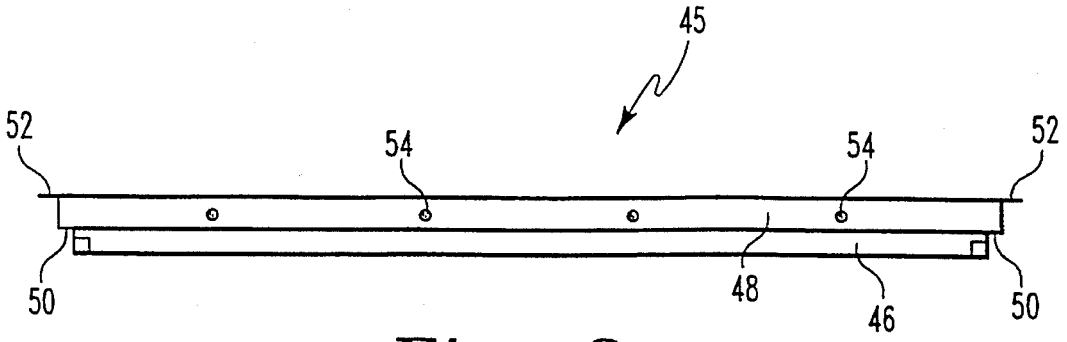
FIG. 3 is an end view, from right of FIG. 1, of the mounting framework of a range top with a plurality of protruding dimples formed in the mounting framework to engage the glass panel-elastic seal assembly of FIG. 2.

Each wall 42, 43, 44, 45 has the same cross section, which can be seen by reference to the side wall 45 shown in FIG. 3. Each wall 42, 43, 44, 45 includes a lower vertical wall portion 46 and an upper vertical wall portion 48. A horizontal ledge 50 extends outwardly from the lower vertical wall portion 46 to the upper vertical wall portion 48 and supports the range top panels 12, 14 and 16 when assembled to the range top. The end wall 45 further includes a plurality of protruding means 54 which project toward the interior of the rectangular box. The protruding means 54 are shaped generally to conform to the contour of the first receiving groove 40 formed in the elastomeric band 26 to securely engage the glass panel-elastic seal assembly 20. Preferably, the protruding means 54 are a plurality of dimples, as shown in FIG. 3, but a single protruding means, such a formed tongue or flange that will effectively engage the first receiving groove 40 can be used.

Figure 8:
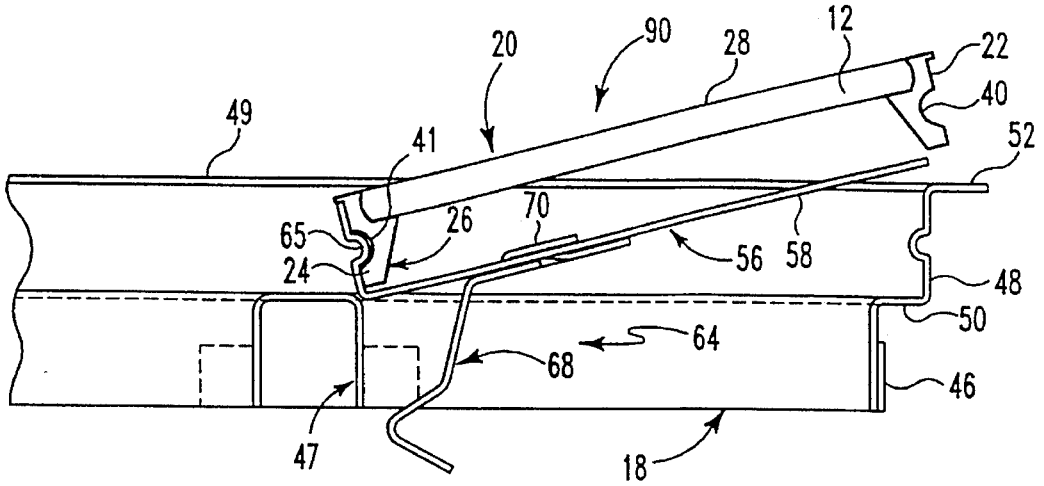
FIG. 8 is an end view of glass panel-elastic seal assembly of FIG. 2 coupled to the carrier of FIGS. 4–6 and the spring fastener of FIGS. 7A and 7B, the carrier assembly being in an initial installation position.
Figure 9:
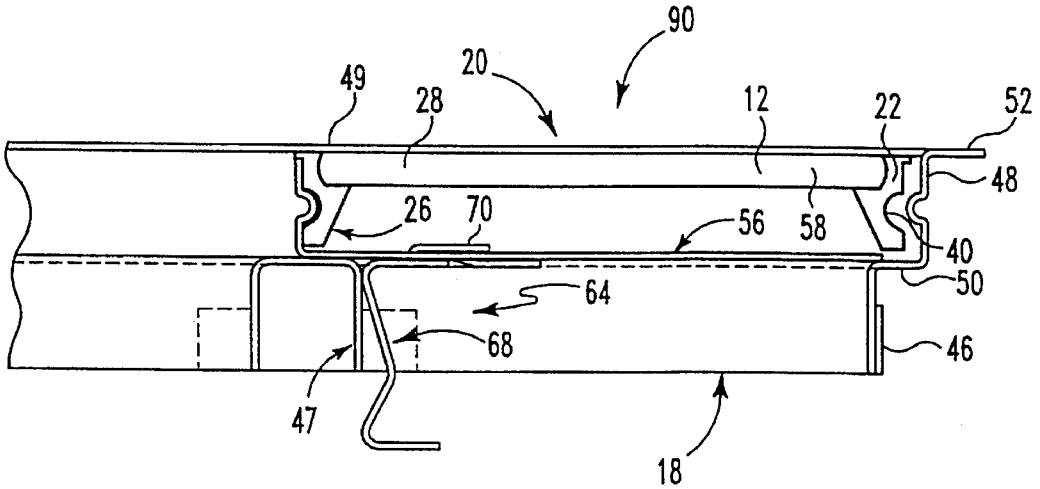
FIG. 9 is an end view of the carrier assembly of FIG. 8 showing the assembly aligned to engage the mounting framework.
Figure 10:
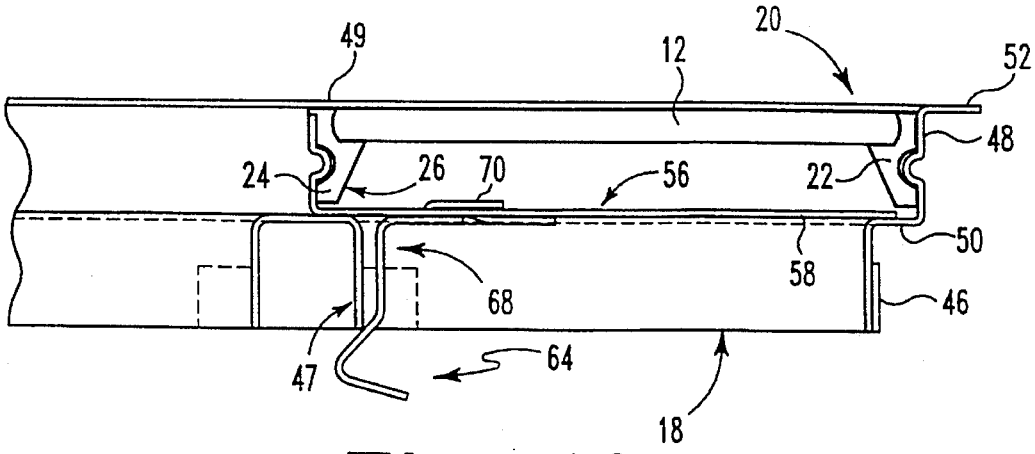
FIG. 10 shows the carrier assembly of FIGS. 8–9 sealingly engaged with the mounting framework.

A decorative top perimeter flange 52 extends around the mounting frame 18 and projects outwardly from the upper vertical wall portions 48 of each wall 42, 43, 44, 45. A plurality of decorative cross pieces 49 extend between the side walls 42, 43 in the plane of the top perimeter flange 52 and in registry with the strengthening cross members 47. As shown in FIGS. 8–10, the cross members 47 can be U-shaped to provide a rigid mounting framework.

Figure 2:
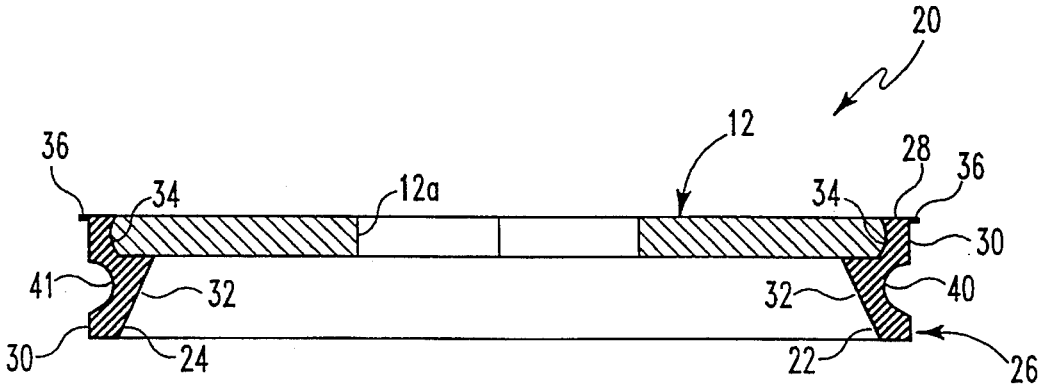
FIG. 2 is a cross-sectional view of a glass panel-elastic seal assembly of the invention, which is shown connected to a mounting framework of a range top in FIG. 1.
Figure 5:
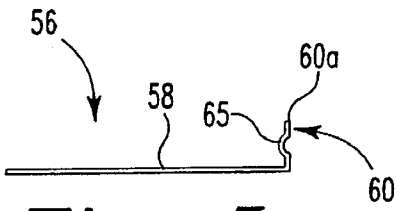
FIG. 5 is an end view of the carrier of FIG. 4 showing a tongue formed for engaging the glass panel-elastic seal assembly.
Figure 6:
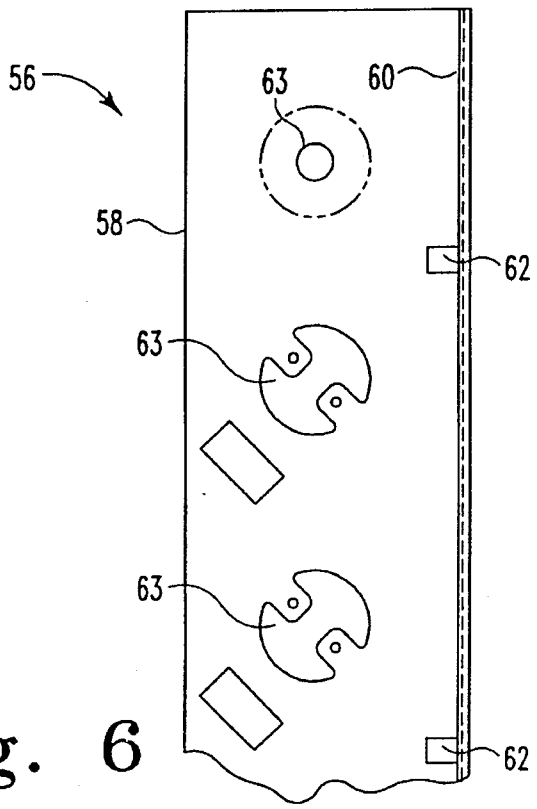
FIG. 6 is a top view of the carrier of FIGS. 4 and 5 showing a plurality of apertures formed to permit attachment of a plurality of spring fasteners and range burner controls.
Figure 4:
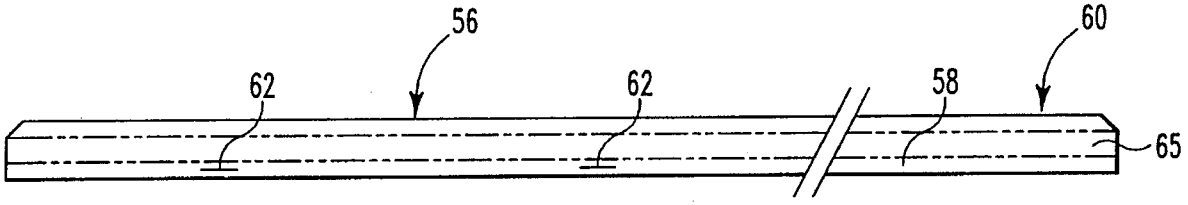
FIG. 4 is a side view of a preferred carrier of the invention for the glass panel-elastic seal assembly of FIG. 2.

As set forth above, the invention further provides a carrier for removably and sealingly connecting the glass panel-elastic seal assembly with the range top. A preferred carrier 56 for the glass panel-elastic seal assembly 20 of FIG. 2 is shown in FIGS. 4–6. As shown in FIGS. 4–6, the carrier 56 includes a horizontal control plate 58 and a generally vertical flange 60 extending at substantially 90° from one edge of the horizontal plate 58. As shown in FIG. 6, the horizontal control plate 58 has substantially the same plan form as the control panel 12 and includes a plurality of spaced apertures 62 for receiving one or more spring fasteners 64 (FIGS. 7A–7B) and a plurality of apertures 63 for mounting burner and fan controls (not shown) to the control plate 58. The control mounting apertures 63 are positioned so as to allow vertical registry with the apertures 12*a* formed in the control panel 12. The vertical flange 60 includes a tongue 65 which extends longitudinally along the length of the carrier 56 between the top edge 60*a* of flange 60 and the control plate 58 and protrudes partially over the horizontal control plate 58, as shown in FIGS. 4–6.

Figure 7B:
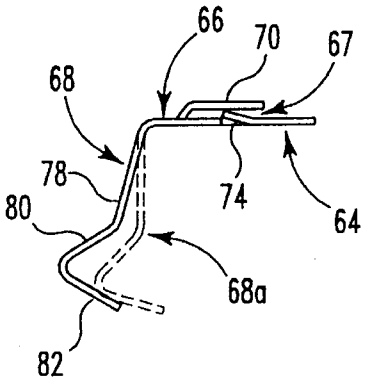
FIG. 7B is a side view of the spring fastener of FIG. 7A showing a compressed position (in phantom) and an uncompressed position.
Figure 7A:
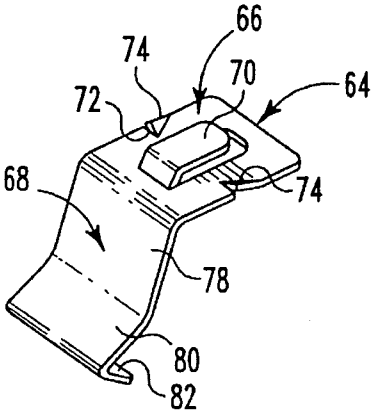
FIG. 7A is a perspective view of a spring fastener for use with the carrier of FIGS. 4–6 to urge the glass panel-elastic seal assembly of FIG. 2 into sealed connection with the mounting framework of FIGS. 1 and 3.

The spring fasteners 64, which provide the resilient portion of carrier 56, are preferably spring clips, which, as illustrated in FIGS. 7A–7B, includes first and second portions 66, 68. As shown in FIG. 7B, the second portion 68 of the spring clip 64 comprises a resilient portion which can be moved to a compressed position, shown in phantom lines 68*a*, by moving the second portion 68 to a more right angle position (toward the right in FIG. 7B), relative to the first portion 66. The first portion 66 includes a control plate-holding tab 70 which is stamped upwardly from the first portion 66 to form a control plate engaging gap 67 substantially equal to the thickness of the control plate 58. A pair of transverse cuts 72 are made in the first portion 66. The first portion 66 is bent upwardly and inwardly immediately adjacent the cuts 72 to form a pair of triangular control plate-engaging tabs 74.

The second portion 68 of spring clip fastener 64 includes a first segment 78 that extends downwardly at an obtuse angle from the first portion 66. A second segment 80 of the second portion 68 extends from the first segment 78 at a further obtuse angle in a direction away from, and toward parallel to, the first portion 66, and a third segment 82 of the second portion 68 is bent backwardly at an acute angle from the second segment 80. Spring clip fastener 64 can thus be formed from a resilient metal such as spring steel for engagement with the control plate portion 58 of carrier 56 and with the mounting framework 18 of the range top.

The glass control panel 12, elastomeric band 26, carrier 56 and spring fastener 64 combine to form a carrier assembly 90, as illustrated in FIGS. 8–10, for removable and sealing installation in and connection to the mounting framework 18. The glass control panel 12 is sealed to the elastomeric band 26 to form a glass panel-elastic seal unit assembly 20, as described above. Although not shown in FIGS. 8–10 to avoid confusion of the drawings, controls for the range top burners and the range top fan can be fastened to the control plate 58 of carrier 56 at the apertures 63 before the glass panel-elastic seal assembly 20 is assembled with the carrier 56. After the range controls are fastened onto the control plate 58, the glass panel-elastic seal assembly 20 is then positioned on the carrier 56 so that the longitudinal tongue 65 formed on the vertical flange 60 engages the second receiving groove 41 of the elastomeric band 26. The elastomeric band 26 does not rest on the control plate 58 when the glass panel-elastic seal assembly is installed on carrier 56 to provide some room for expansion of the elastomeric hand 26. A plurality of spring fasteners 64 are pushed into the apertures 62 of control plate 58, with the control plate 58 positioned in the gap 67 between the first portion 66 and the holding tab 70 of the spring fastener 64. As the spring clips 64 are inserted into the apertures 62 of the control plate 58, the engaging tabs 74 are deflected by the control plate 58. The resilient engaging tabs 74 are oriented so their resilient engagement of the control plate 58 retain the spring fasteners 64 in the apertures 62 of the control plate. Movement of the control plate 58 out of the gap 67 of the spring dip 64 causes the engagement tabs 74 to dig into the control plate 74, resisting such movement.

The carrier assembly 90 can be installed in the mounting framework 18 in a series of steps, as illustrated in FIGS. 8–10. Referring to FIG. 8, the assembly 90 is rotated about 30–45 degrees from the horizontal (in a counterclockwise direction in FIG. 8) and inserted into the mounting framework 18 with the glass panel-elastic seal assembly 20 placed below the cross piece 49 and the carrier 56 resting on the cross member 47. The carrier assembly 90 is then rotated back to the horizontal (in a clockwise direction on FIGS. 8–10) and urged to the left to deflect the second portion 68 of the spring fasteners 64 (to the right as shown in FIG. 9). The top surface 28 of the glass panel-elastic seal assembly 20 shown is disposed just below the plane of the top perimeter flange 52 and the control plate 58 of carrier 56 rests on the horizontal supporting ledge 50 with the first receiving groove 40 aligned with the protruding means 54 in the mounting framework 18.

The carrier assembly 90 is then released to slide to the right in response to the resilience and urging of the second portions 68 of the spring clip fasteners 64 to the position shown in FIG. 10. When the assembly 90 has moved to the right, the first receiving groove 40 engages the protruding means 54, a plurality of dimples in the illustrated embodiment, in the mounting framework 18, so that the elastomeric band 26 is compressed between the mounting framework 18 and the flange 60 of carrier 56, and is thereby held in a sealed position. In this position, the sealing lip 36 is pushed up against the mounting framework 18 to provide an additional seal against spills, boilovers and other foreign materials on the top surface 28 of the glass panel 12 from entering the interior of the range top between the mounting framework 18 and glass range top panel 12.

To remove the glass panel-elastic seal assembly 20, for example, to service an associated control, it is only necessary to deform the spring fasteners 64, by urging the glass panel-elastic seal assembly 20 to the left as shown in FIG. 10, to disengage the first receiving groove 40 from the protruding means 54 (as shown in FIG. 9), and then to rotate the glass panel-elastic seal assembly 20 to the position shown in FIG. 8 so it may be lifted from the mounting framework 18. Following any maintenance of the range top interior, the glass panel-elastic seal assembly 20 may be reinstalled as described above, reinstating the sealed range top.

Although the invention has been described in detail with reference to a certain preferred embodiment, variations and modifications exist within the scope and spirit of the invention as described and defined in the following claims. As indicated above, the invention has been described in an embodiment including a glass control panel for a range top to demonstrate an exemplary advantage of servicing range controls, the invention is, however, applicable to other range top panels and to range top materials other than glass.

We claim:

1. Apparatus for sealing engagement of a glass range top panel with a mounting framework, comprising:

a glass range top panel, an elastomeric band including a panel-receiving groove, coupled to the glass range top panel, and a carrier coupled to the elastomeric band for resiliently and sealingly retaining the glass range top panel in the mounting framework.

2. The apparatus of claim 1, wherein the elastomeric band further includes lip means for engaging the mounting framework and a framework engaging portion for retention of the glass range top panel position with respect to the mounting framework.

3. The apparatus of claim 1, wherein the carrier includes a control plate for controls associated with the glass range top panel.

4. The apparatus of claim 1, wherein the carrier includes a flange and the elastomeric seal includes flange-engaging portion for retention of the glass range top panel position with respect to the carrier.

5. The apparatus of claim 2, wherein the mounting framework includes protruding means for engaging the framework-engaging portion of said elastomeric seal.

6. The seal of claim 5, wherein the protruding means includes a plurality of dimples.

7. The apparatus of claim 5, wherein the carrier includes resilient means for urging the framework-engaging portion of the elastomeric seal into engagement with the protruding means.

8. The apparatus of claim 6 wherein the resilient means includes at least one spring fastener with a deformable resilient portion for resilient engagement of the mounting framework, thereby providing retention, removability and sealing engagement for the glass range top panel.

9. Apparatus for removably and sealingly connecting a glass panel to a range top framework, comprising:

a glass panel;

an elastic seal attached at the periphery of the glass panel; and a carrier for said glass panel, including a flange for engagement with said elastic seal, said elastic seal including at its periphery surface portions for engagement with said flange of said carrier and said range top framework, said carrier comprising at least one resilient portion for engaging, and fastening said carrier to, said range top framework, said at least one resilient portion, upon engagement with said range top framework, urging said elastic seal into sealing engagement with said range top framework and said flange of said carrier.

10. The apparatus of claim 9 wherein the elastic seal comprises:

first means for receiving the glass panel, second means, coupled to the first means, for receiving the range top framework, and lip means, coupled to the first means, for sealingly engaging the range top framework.

11. The apparatus of claim 10, wherein the first receiving means includes a glass panel-receiving groove and the second receiving means includes a framework-receiving groove.

12. The apparatus of claim 10, wherein the first means, second means and lip means are formed in a unitary elastomeric band extending around the periphery of the glass panel, with said first and second means comprising grooves formed on opposing sides of said elastomeric seal.

13. The apparatus of claim 9 wherein said carrier includes a plate-like portion extending transversely from said flange.

14. The apparatus of claim 13 wherein said plate-like portion extends from said flange at substantially a right angle under, and for substantially the width of, said glass panel.

15. The apparatus of claim 14 wherein said glass panel includes at least one aperture and said plate carries at least one range control in position for the operator of said range control to extend through said at least one aperture of the glass panel.

16. The apparatus of claim 13 wherein said resilient portion comprises, at least one spring clip attached to said plate-like portion.

17. The apparatus of claim 16 wherein said plate-like portion includes a plurality of openings in spaced relationship along said plate-like portion, and a plurality of spring clips are attached to said plate-like portion in said spaced relationship, each spring clip being attached at one of the plurality of openings and including a deformable resilient portion extending outwardly from said plate-like portion for engagement with the range top framework, said resulting spaced relationship providing substantially uniform engagement of said elastic seal with the range top framework.

18. The apparatus of claim 17 wherein each of said spring clip comprises a plate engaging portion formed of resilient material to grip the plate-like portion adjacent the opening at which it is attached.

19. The apparatus of claim 9 wherein said range top framework comprises a plurality of sides, said sides being formed with at least one vertical portion and at least one horizontal portion, at least two of the plurality of sides extending in a parallel from at least one other of the plurality of sides, one at least one structural member extending between the parallel sides and being spaced from said one other side, said elastic seal engaging said plurality of sides and said resilient portion of said carrier engaging said at least one structural member.

20. The apparatus of claim 19 wherein at least one of said plurality of sides of said range top framework includes a protruding means for engaging said elastic seal.

21. The apparatus of claim 20 wherein said elastic seal comprises an elastomeric portion for engagement with said protruding means.

22. The apparatus of claim 21 wherein said elastomeric portion includes a permanently depressed portion for engagement with said protruding means.

23. The apparatus of claim 22 wherein said elastomeric portion extends along, and includes a groove extending along, said one other side of the plurality of sides and the vertical portion of said one side of said plurality of side includes said protruding means, said protruding means comprising a plurality of inwardly extending dimples spaced along said one side.

24. A removable range top glass panel-seal assembly, comprising a glass range top panel and a peripheral elastomeric band formed with a panel-receiving groove adjacent its top shaped for sealing engagement with the glass range top panel, and with a resilient sealing and frame-engaging outer surface permitting removal of the assembly without tools and without destroying the integrity of its sealing engagement with the glass range top panel and the range top.

* * * * *